US005553383A

United States Patent [19]

Wetzel

[11] Patent Number: 5,553,383

[45] Date of Patent: Sep. 10, 1996

[54] SHAVING FOIL MOUNTING STRUCTURE FOR A DRY SHAVING APPARATUS

[75] Inventor: Matthias Wetzel, Frankfurt, Germany

[73] Assignee: Braun Aktiengesellschaft, Kronberg, Germany

[21] Appl. No.: 335,790

[22] PCT Filed: Apr. 23, 1993

[86] PCT No.: PCT/EP93/00987

§ 371 Date: Mar. 28, 1995

§ 102(e) Date: Mar. 28, 1995

[87] PCT Pub. No.: WO93/23213

PCT Pub. Date: Nov. 25, 1993

[30] Foreign Application Priority Data

May 11, 1992 [DE] Germany ..... 42 15 398.0

[51] Int. Cl.[6] ..... B26B 19/04

[52] U.S. Cl. ..... 30/43.92; 30/346.51

[58] Field of Search ..... 30/43.92, 43.91, 30/43.9, 346.31

[56] References Cited

U.S. PATENT DOCUMENTS

| | | | |
|---|---|---|---|
| 2,360,679 | 10/1944 | Holsclaw . | |
| 3,440,725 | 4/1969 | Messinger et al. . | |
| 4,726,116 | 2/1988 | Schweingruber et al. | 30/43.92 |
| 4,991,295 | 2/1991 | Messinger | 30/43.92 |

FOREIGN PATENT DOCUMENTS

| | | |
|---|---|---|
| 1168796 | 7/1962 | Germany . |
| 1801545 | 10/1968 | Germany . |
| 2019746 | 4/1970 | Germany . |
| 53-55273 | 5/1978 | Japan . |

*Primary Examiner*—Douglas D. Watts
*Attorney, Agent, or Firm*—Fish & Richardson, P.C.

[57] ABSTRACT

The invention is directed to a shaving foil mounting structure for a dry shaving apparatus, comprising a shaving foil of arched form attached to a shaving head frame by means of bolts or the like, against which foil an inner cutter operating in a reciprocating motion is resiliently engaged, and further comprising strip members arranged on the longitudinal sides of the shaving foil, the strip members including mounting members cooperating with the bolts, wherein the two strip members are provided on the outer surface of the shaving foil, and the mounting members of each strip member that cooperate with the bolts include cutouts open in the direction of the perforated area of the shaving foil, each cutout accommodating a respective detent means movable in the plane of the strip member, and wherein each strip member includes adjacent to one of the two cutouts a slot open in the direction of the perforated area of the shaving foil, said slot being in engagement with a rib member formed on the associated location of the shaving head frame with the shaving foil in assembled condition.

8 Claims, 3 Drawing Sheets

SHAVING FOIL MOUNTING STRUCTURE FOR A DRY SHAVING APPARATUS

This invention relates to a shaving foil mounting structure for a dry shaving apparatus, comprising a shaving foil of arched form attached to a shaving head frame by means of bolts or the like, against which foil an inner cutter operating in a reciprocating motion is resiliently engaged, the foil having on its longitudinal sides a strip member each which is provided with mounting members cooperating with the bolts.

In prior known shaving foil mounting structures of this type (DE-11 68 796 and DE-20 19 746 B2), there are attached to the longitudinal sides of the shaving foil inner surface, that is, to the shaving foil surface cooperating with the inner cutter, a strip member each which has resilient arms configured in the manner of an eyelet and embracing the bolts in the manner of a snap fastener. This results in a certain amount of flexibility of the mounting structure, enabling the shaving foil to recede towards the interior of the shaving head frame together with the inner cutter under the action of the shaving pressure. To prevent the undesired effect of the shaving foil being movable in the direction of the operating motion of the inner cutter, means acting by frictional or positive engagement are provided. While such known shaving foil mounting structures have resulted in an appreciable advance as compared with earlier, substantially rigid, mounting structures, they are yet worthy of improvement particularly as regards their manipulation. It is in particular the insertion and removal of the shaving foil into and, respectively, from the shaving head frame using a motion essentially normal to the frame inner surface, the probing for the bolt-and-hole connection as the shaving foil is inserted, as well as the overcoming of the closing force of the snap fastener for detachment that tend to present difficulties for the user, resulting in damage to the shaving foil.

It is accordingly an object of the present invention to provide a shaving foil mounting structure which affords substantially greater ease of assembly and demounting of the shaving foil, combined with low space requirements in the interior of the shaving head frame, while maintaining the above-identified advantages of prior known mounting structures.

According to the present invention, this object is accomplished by the means identified in the characterizing portion of the main claim.

The shaving foil mounting structure of the present invention has the advantage that assembly and detachment of the shaving foil to and from the shaving head frame are accomplished using a simple sliding motion lengthwise of the frame inner wall or alternatively, at right angles thereto, with the detent and locating means taking effect automatically. The shaving foil is practically not exposed to mechanical loads, and the inner cavity of the shaving head frame enclosed by the shaving foil remains free from the mounting members. This in turn enables the complete shaving head to be built to narrow dimensions, if so desired, and to be cleaned very easily.

The movable detent means provided within the cutouts may be configured and arranged in a variety of ways; particularly advantageously, the present invention prefers a hook member extending upwardly from the base of the respective cutout towards the opening thereof, which hook member is movable in the plane of the strip member transversely to the sliding motion as the shaving foil is inserted. This enables the strip member to be built to relatively narrow dimensions while its length which is determined by the dimensions of the shaving foil is unchanged. Preferably, the angled ends of the two hook members of a strip member are arranged so as to face each other; this results in a yielding motion of the hook members in opposite directions as the shaving foil is locked in place or unlocked, avoiding a one-sided lateral displacement or interlocking.

In an advantageous embodiment of the present invention, the bolts are of a rectangular cross-section and are provided with a dovetail guide each on one of the two longitudinal walls of the shaving head frame on the vertical sides facing each other, the longitudinal sides of the respective cutout in the strip member that are associated with the guides are beveled such that the guides are in engagement with the beveled sides when the shaving foil is in mounted condition. This arrangement ensures that the shaving foil cannot lift itself clear of the frame wall and that the engagement position is attained automatically without any further manipulation.

In order to ensure the requisite movability of the shaving foil in its mounting structure to enable it to recede, each cutout is conveniently dimensioned such that in the rest position a defined distance is maintained between the angled end of each hook member and the associated bolt with the shaving foil in assembled condition.

In an advantageous embodiment of the present invention, also a one-sided receding motion of the shaving foil is made possible in that the slot receiving the rib member is enlarged at its base, enabling the rib member to occupy an inclined position relative to the slot.

According to a further advantageous embodiment of the present invention, a particularly smooth surface of the inner cavity of the shaving head frame enclosed by the shaving foil is obtained by reducing the thickness of the longitudinal walls of the shaving head frame in the area of the shaving foil attachment locations by the amount of thickness of the strip member, such that the remaining section of the longitudinal wall is flush with the strip member of the shaving foil when mounted. This facilitates cleaning of the shaving head frame significantly because of the absence of corners in which hair dust may collect.

In order to facilitate manipulation of the shaving foil during assembly and demounting, each strip member has on its inner side close to the shaving foil gripping ridges, the shaving foil being suitably cut out at this location.

An embodiment of the present invention is illustrated in the accompanying drawings. In the drawings, FIG. 1 is a view of a dry shaving apparatus having a portion broken away to show a section of an inner cutter;

Figure 2:
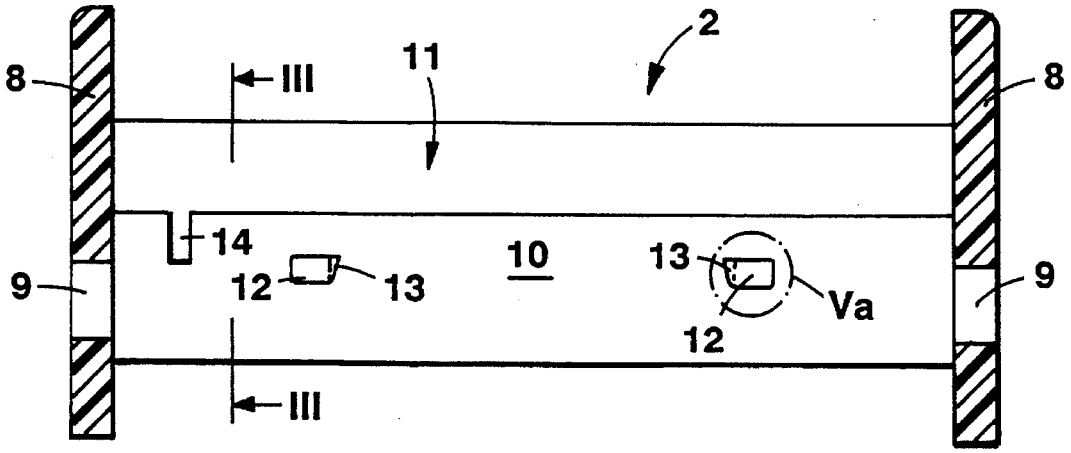
FIG. 2 is a sectional view of one half of a shaving head frame, taken along the line II—II of FIG. 3.
Figure 3:
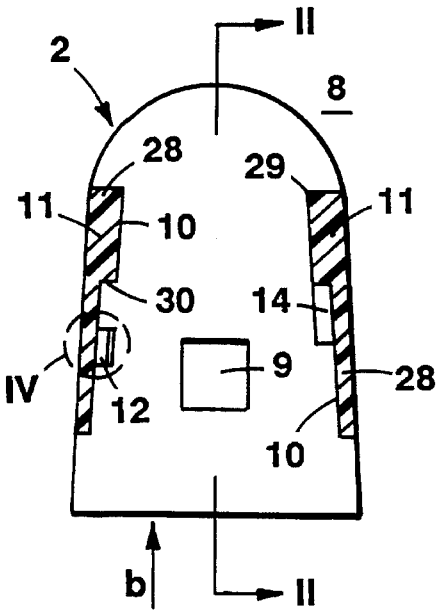
FIG. 3 is a sectional view of the shaving head frame, taken along the line III—III of FIG. 2.
Figure 4:
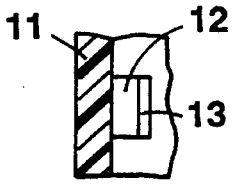
FIG. 4 is a sectional view, on an enlarged scale, of a longitudinal wall having the bolt of FIG. 3 formed thereon.
Figure 5A:
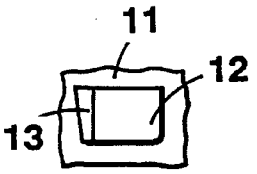
Figure 5B:
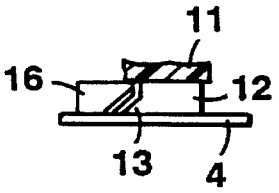
Figure 6:
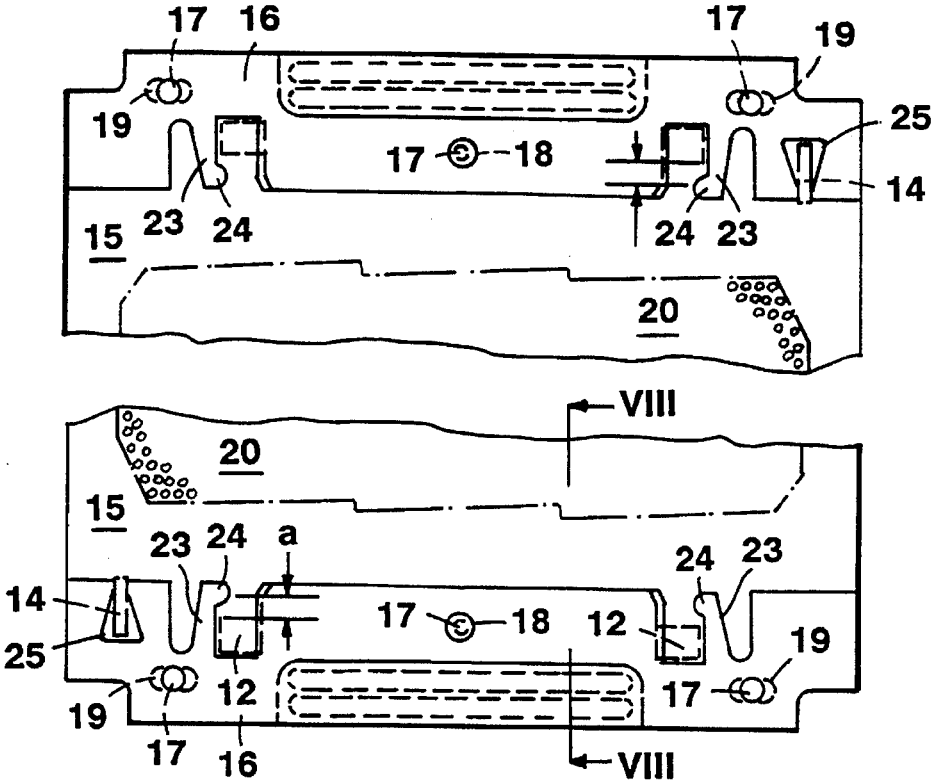
Figure 7:
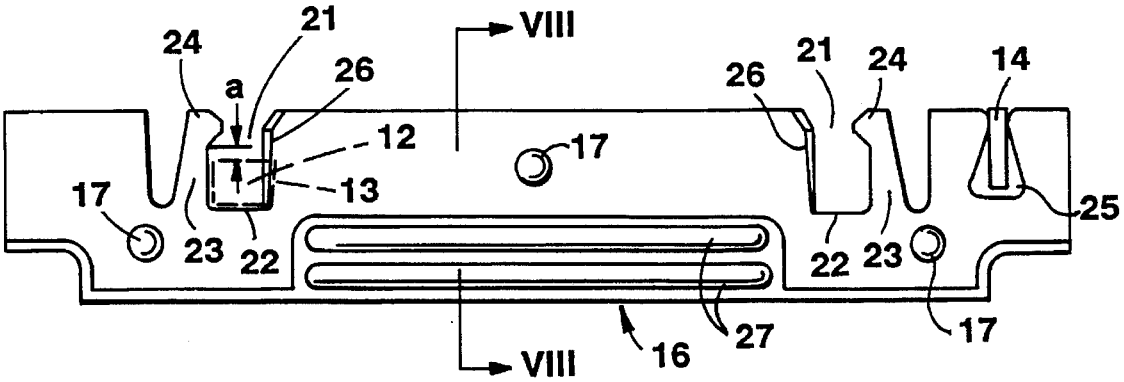
Figure 8:
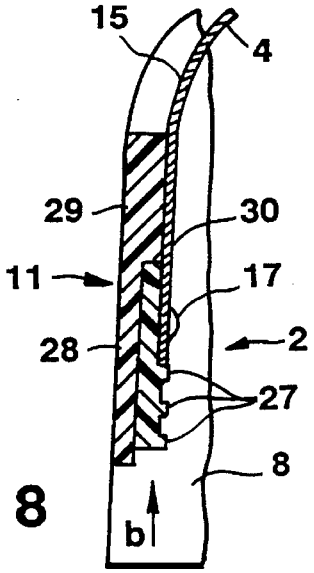

FIG. 5*a* is a front view of a bolt of FIG. 2 (circle Va) and of FIG. 4;

FIG. 5*b* is a sectional view of a longitudinal wall showing bolt and strip member;

FIG. 6 is a view of the shaving foil with its mounting members as seen from outside, that is, the skin engaging side;

FIG. 7 is a view, on an enlarged scale, of a strip member with its mounting members as seen from inside, that is, the inner cutter engaging side; and FIG. 8 is a sectional view of a portion of the shaving head frame with the shaving foil assembled, taken along the lines VIII—VIII of FIGS. 6 and 7.

Figure 1:
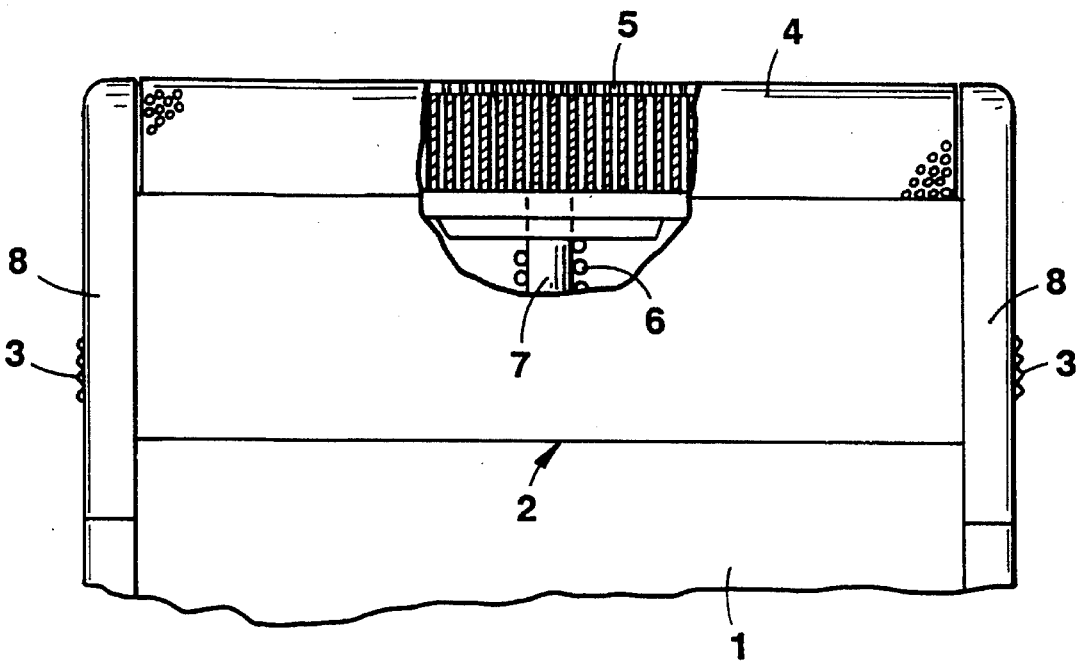

The dry shaving apparatus of which a portion is shown in FIG. 1 includes a housing 1 on which a detachable shaving head frame 2 is fitted; depressible members 3 are provided for locking and releasing the frame. Attached to the shaving head frame 2 is a shaving foil 4 of arched form against which an inner cutter 5 is urged by means of a spring 6. Through the intermediary of an oscillating lever 7, the inner cutter 5 is caused to perform a reciprocating working motion by a motor, not shown, which is accommodated in the housing 1.

Provided in the end walls 8 of the shaving head frame 2 are apertures 9 for extension therethrough of respective depressible members 3. Formed on the two inner surfaces 10 of the frame longitudinal walls 11—see FIG. 2—are bolts 12 of a rectangular cross-section having on their longitudinal sides facing each other a respective dovetail guide 13. Further, a respective rib member 14 is formed on these inner surfaces 10 adjacent to a respective one of the two bolts 12, such that the rib members 14 of the two inner surfaces 10 are diagonally opposite each other.

Secured to the outer surface 15 of the shaving foil 4, that is, the skin engaging surface, parallel to the attachment edge of the shaving foil 4, is a strip member 16 made of a material of limited flexibility, the securing means being three buttons 17 formed on the strip member 16 and extending through a central round hole 18 and two elongate holes 19 in the shaving foil 4 and being welded thereto.

The two strip members 16 of the shaving foil 4 are provided with mounting members at the locations registering with the bolts 12 of the shaving head frame 2, comprising on each strip member 16 two cutouts 21 open in the direction of the perforated area 20 of the shaving foil 4, and a respective hook member 23 formed therein which extends upwardly from the base 22 of the cutout 21 in the direction of its opening and is pivotal in the plane of the strip member 16 owing to its inherent flexibility. The angled ends 24 of the hook members 23 are beveled and arranged in an opposed relationship to each other for each strip member 16, which enables them to move in opposite directions.

Provided on each strip member 16 adjacent to one of the two cutouts 21 is a slot 25 widening towards its base and being equally open in the direction of the perforated area 20, the arrangement and dimensions of the slot conforming to the corresponding dimensions of the associated rib member 14.

The longitudinal sides 26 of the respective cutout 21 that are close to the angled ends 24 of the hook members 23 have beveled edges (FIG. 7) and are dimensioned to mate with the guide 13 of the associated bolt 12 which, with the shaving foil 4 assembled, then comes to lie in the space bounded by the hook member 23 and the above-mentioned longitudinal side 26 of the cutout 21, as illustrated in FIG. 7.

Further, formed on the inside of the strip member 16 shown in FIG. 7 are gripping ridges 27. The shaving foil 4 has a suitable cutout at this location, enabling the gripping ridges 27 to be reached from the interior of the shaving head frame 2 with the shaving foil 4 in mounted condition.

The two longitudinal walls 11 of the shaving head frame 2 are divided into two sections 28 and 29 of different thickness, with the thin-walled section 28 serving to receive the associated strip member 16 (FIG. 8). In this arrangement, the dimensions are selected such that the sum of the thickness dimensions of the thin-walled section 28 and of the associated strip member 16 equals the thickness of the other section 29. In this manner, the inner cavity of the shaving head frame 2 is largely kept free from crevasses, enabling it to be built to relatively narrow dimensions and to be cleaned with ease.

For mounting the shaving foil 4 in the shaving head frame 2, a first step involves positioning its strip members 16 against the thin-walled sections 28 of the longitudinal walls 11, subsequently shifting the foil upwardly in the direction of the arrow b (FIG. 8) until the strip members 16 abut the shoulders 30 of the thick-walled sections 29 of the two longitudinal walls 11. As this shifting motion occurs, each bolt 12 is moved in front of the opening of the associated cutout 21 in the strip member 16, pivoting the hook member 23 through engagement with its beveled end 24 sideways into the open position and continuing its sliding motion until it hits the base 22 of the cutout 21 and the hook member 23 is returned to its initially closed position. Simultaneously with this sliding motion, the beveled longitudinal sides 26 of the two cutouts 21 of each strip member 16 move into engagement with the dovetail guides 13 of the two bolts 12. This securely captures the shaving foil 4 in the mounting structure in the sliding direction, in addition to preventing it from disengaging from the longitudinal wall 11 of the shaving head frame 2. At the same time, also the rib member 14 engages within the slot 25 of the associated strip member 16, thus reliably preventing the shaving foil 4 from being compelled to follow the engaging inner cutter 5 in its working movements.

Each bolt 12 is allowed a predetermined vertical clearance of motion in its mounting structure previously described, which clearance is determined by a defined distance a at the end 24 of the hook member 23, thus enabling the shaving foil 4, together with the inner cutter 5, to recede towards the interior of the shaving head frame 2 under the action of the shaving pressure; the special configuration of the slot 25 with its enlargement at the base additionally ensures a one-sided receding or tilting motion of the shaving foil 4. To remove the shaving foil 4 from the shaving head frame 2, it is grasped by its gripping ridges 27 and withdrawn from the mounting structure in opposition to the direction of the arrow b, with the hook members 23 then performing the above-described pivoting motion in the reverse order. Damage to the shaving foil 4 is thus reliably prevented from occurring in both the assembly and the removal operation.

I claim:

1. A shaving head for a dry shaving apparatus, the shaving head comprising:

a shaving head frame having bolts and rib members;

a shaving foil of arched form having two longitudinal sides and a perforated area, the shaving foil having on the outer surface of each longitudinal side a strip member, each strip member provided with mounting members cooperating with the bolts of the shaving head frame such that the shaving foil is attached to the shaving head frame, wherein the mounting members of each strip member are configured as two cutouts open in the direction of the perforated area, each of the cutouts having a detent movable in a plane defined by each strip member during engagement of a bolt with the cutout, and each strip member having a slot open in the direction of the perforated area and in engagement with a rib member formed on the shaving head frame with the shaving foil in an assembled condition; and an inner cutter operating in a reciprocating motion resiliently engaged against the shaving foil.

2. A shaving head as claimed in claim 1 wherein each cutout has a base and each detent is configured as a hook extending in the upward direction from the base of the respective cutout towards the opening thereof, said detent being movable in the plane defined by the strip member transversely to the upward direction of the hook.

3. A shaving head as claimed in claim 2 wherein the hooks of the two detents on each strip member have angled ends arranged so as to face each other.

4. A shaving head as claimed in claim 1 wherein the shaving head frame has longitudinal walls on vertical sides facing each other, and each cutout in the strip members has a longitudinal side, and wherein the bolts of the shaving head frame are of a rectangular cross-section and are provided with a dovetail guide, each bolt located on one of the longitudinal walls of the shaving head frame and wherein the longitudinal sides of the respective cutout in the strip member that are associated with the guides have beveled edges, and wherein the guides are in engagement with the beveled longitudinal sides of the cutouts when the shaving foil is in the assembled condition.

5. A shaving head as claimed in claim 3 wherein the shaving foil is moveable between a rest position and a receded position, and each cutout is dimensioned such that in the rest position a defined distance is maintained between the angled end of the hook of each detent and the bolt with the shaving foil in the assembled condition.

6. A shaving head as claimed in claim 1 wherein the slot is enlarged at the end opposite from its open end.

7. A shaving head as claimed in claim 4 wherein the thickness of the longitudinal walls of the shaving head frame in the area where the shaving foil is attached is reduced by the amount of thickness of the strip member, such that the remaining section of the longitudinal wall is flush with the strip member of the shaving foil when in the assembled condition.

8. A shaving head as claimed in claim 1 wherein each strip member has on its inner side close to the shaving foil gripping ridges.

* * * * *